United States Patent [19]

Mandigo et al.

[11] 4,198,248

[45] Apr. 15, 1980

[54] HIGH CONDUCTIVITY AND SOFTENING RESISTANT COPPER BASE ALLOYS AND METHOD THEREFOR

[75] Inventors: Frank N. Mandigo, North Branford; John F. Breedis, Trumbull, both of Conn.

[73] Assignee: Olin Corporation, New Haven, Conn.

[21] Appl. No.: 11,595

[22] Filed: Feb. 12, 1979

Related U.S. Application Data

[63] Continuation of Ser. No. 789,967, Apr. 22, 1977, abandoned.

[51] Int. Cl.[2] ..... C22F 1/08

[52] U.S. Cl. ..... 148/2; 75/153; 148/11.5 C; 148/32

[58] Field of Search ..... 75/153; 148/2, 11.5 C, 148/32, 32.5

[56] References Cited

U.S. PATENT DOCUMENTS

| | | | |
|---|---|---|---|
| 2,311,750 | 2/1943 | Hensel et al. | 75/153 |
| 2,422,752 | 6/1947 | Seybolt | 75/153 |
| 3,392,016 | 7/1968 | Opie et al. | 75/153 |
| 4,049,426 | 9/1977 | Watson et al. | 75/153 |

*Primary Examiner*—R. Dean
*Attorney, Agent, or Firm*—Paul Weinstein

[57] ABSTRACT

An alloy which exhibits superior resistance to softening at elevated temperatures while maintaining high strength properties is disclosed. This alloy includes from 0.005 to 0.2% by weight for each of niobium and zirconium in a copper base. Magnesium may also be added in amounts ranging up to 0.01% by weight.

7 Claims, 2 Drawing Figures

HIGH CONDUCTIVITY AND SOFTENING RESISTANT COPPER BASE ALLOYS AND METHOD THEREFOR

This is a continuation of application Ser. No. 789,967, filed Apr. 22, 1977, abandoned.

BACKGROUND OF THE INVENTION

Improved resistance to softening and high electrical conductivity of copper and copper base alloys is of considerable interest in electronics applications. This is due to the fact that short time exposure to fairly high heat such as that used in soldering and spot welding operations, used extensively in such applications, causes loss of strength of cold worked material utilized as semiconductor lead frames and heat sinks. The alloys which have most commonly been utilized for such applications have been the silver-bearing, tough-pitch and oxygen-free copper base alloys containing up to 25 troy ounces of silver per avoirdupois ton of alloy. Other alloys which have been suggested for such applications include a copper base alloy containing between 0.02 and 1.5% by weight niobium, either with or without an aluminum addition ranging between 0.1 and 1.0% by weight such as that found in U.S. Pat. No. 2,422,752. Alloy 155 (Copper Development Association designation) is reported to exhibit high electrical conductivity (90% IACS in the annealed temper) and high resistance to softening through the addition of between 8 and 30 ounces of silver per ton of alloy in conjunction with 0.04 to 0.08% by weight phosphorus and 0.01 to 0.12% by weight magnesium.

The combination of magnesium and zirconium has been proposed as an addition to copper in U.S. Pat. No. 3,392,016 in order to improve the softening resistance of copper which is subjected to high temperature conditions such as soldering. This patent compares the magnesium-zirconium copper with such alloys as copper-zirconium-phosphorus alloys. There is no indication in the patent that niobium may be added to such an alloy.

SUMMARY OF THE INVENTION

In accordance with the present invention, an improved copper base alloy has been developed which exhibits resistance to softening at high temperatures while maintaining high electrical conductivity. The alloy system of the present invention contains niobium and zirconium as principal alloying elements to enable the alloy to exhibit such a combination of properties. The alloy should be free from any silver additions, which helps to reduce the overall alloy cost. Such an alloy system exhibits superior softening resistance when compared to the silver-bearing alloys disclosed hereinabove. Magnesium may be added to the alloy in order to serve primarily as a deoxidant and to improve recovery of the niobium addition to the alloy.

Accordingly, it is a principal object of the present invention to provide a copper base alloy which exhibits the properties of high softening resistance and high electrical conductivity.

It is a further object of the present invention to provide such an alloy which is free from silver.

It is an additional object of the present invention to provide such an alloy which does not depend upon precipitation phenomena to attain such a combination of softening resistance and high electrical conductivity.

Further objects and advantages of the present invention will become more apparent from a consideration of the following specification.

DETAILED DESCRIPTION

Figure 1:
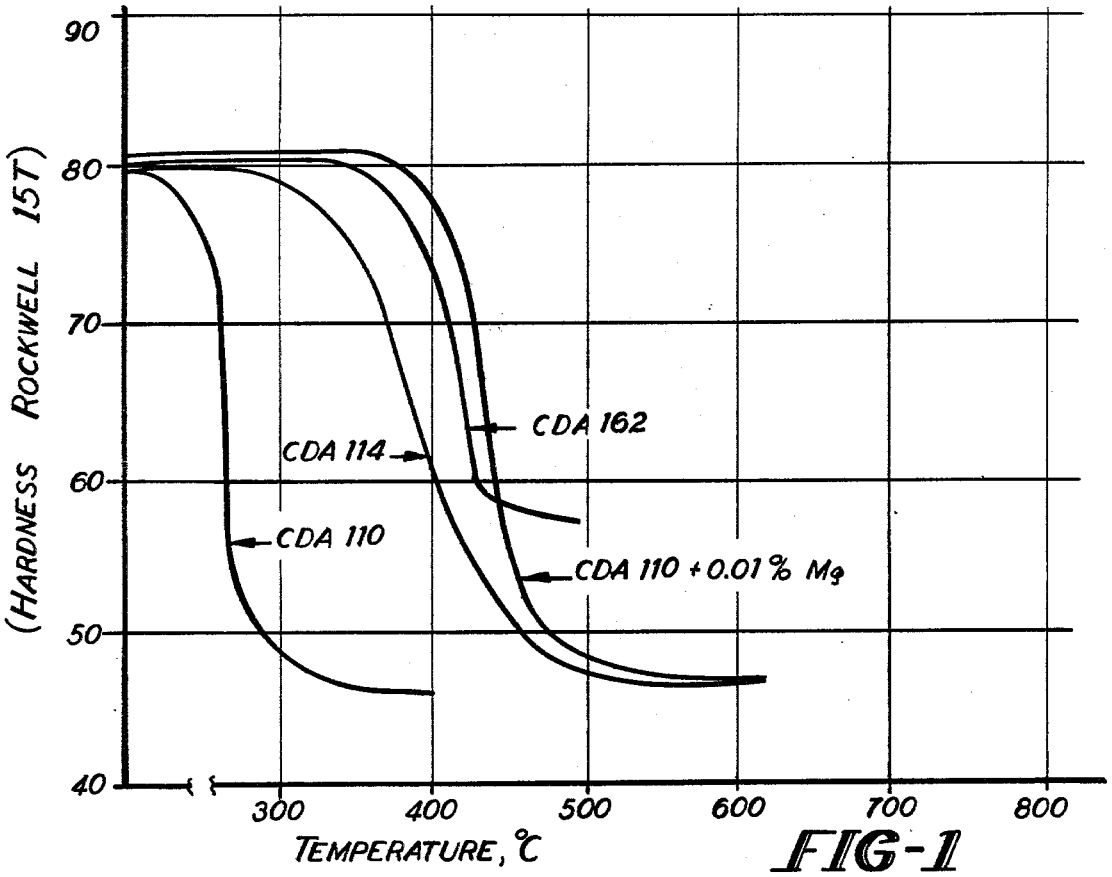
FIG. 1 is a graph showing the softening resistance at various temperatures of several alloys, including Alloy 110 to which magnesium has been added.

The copper base alloy of the present invention contains, as essential elements, niobium and zirconium. Both the niobium and zirconium should generally be present in the alloy in a range of between 0.005 and 0.2% by weight for each element. The preferred range for each element should be between 0.01 and 0.05% by weight. Alloys containing niobium and zirconium in amounts set in the lower end of the aforementioned ranges are particularly preferred for attaining the desired superior softening resistance at high temperatures while maintaining the highest possible electrical conductivity. The softening resistance of such an alloy at high temperatures is not significantly improved at alloying element concentrations beyond the ranges noted above and, furthermore, electrical conductivity at such high ranges is greatly lowered.

The present invention also contemplates the use of magnesium as an alloying element in amounts ranging up to 0.01%. It is already known that a magnesium addition by itself to copper can help to improve the softening resistance of the resulting alloy. When magnesium is added with niobium and zirconium according to the present invention, the resultant softening resistance of the alloy is far superior to the softening resistance provided by magnesium alone. This fact is most evident with increasing exposure time at high temperature. The role of magnesium appears to be primarily as a deoxidant in the alloy which acts to improve recovery of the niobium addition to the alloy.

Other alloying elements may be added, singularly or in combination with each other, to the base alloy for the purpose of increasing the strength without decreasing the softening resistance of the alloy. Such elements may include zinc, nickel, tin, aluminum and silicon, which may be added to the limit of their respective solubilities in the respective copper-element binary systems. It should be noted that the electrical conductivity of the resultant alloy will be sacrificed with increased strength, according to the elements which are chosen and the levels in which the elements are added.

The alloy system of the present invention does not depend upon the precipitation of the alloying elements to attain high strength and electrical conductivity properties. In fact, the niobium and zirconium levels utilized in the alloy system of the present invention are such that these respective elements are essentially in solid solution in the alloy.

The amounts and temperatures of both hot and cold working, as well as the particular cooling of the alloy in processing, are not particularly critical to the final properties attained. For example, the temperature range for hot working may range between 750° and 875° C. The amount of reduction during the hot working step is not critical. The amount of cold working is also not particularly critical. This working can vary over a wide range of desired tempers for the final article.

The annealing procedure used in processing the alloy system of the present invention also plays a role in the electrical conductivity obtained for the alloy at the final desired gage. Both intergage and final anneals at 600° C. for three hours, for example, result in an electrical conductivity for the alloy of the present invention which is close to 98.5% IACS, regardless of the presence of retained magnesium, if added, in the alloy. Annealing such an alloy at 400° C. for three hours, for example, results in a lower electrical conductivity for the alloy but higher strength properties. Softening behavior of the alloy is not affected by annealing practice. Obviously, a yield strength/electrical conductivity combination must be determined which depends upon the final desired use for the alloy. For example, the yield strength/electrical conductivity combination which is developed at final gage in the one-half hard temper for both 400° C. and 600° C. annealing is 62 and 47 ksi, respectively, and 94.5 and 98.5% IACS electrical conductivity for each annealing temperature. In any event the electrical conductivity for the alloy of the present invention should be at least 90% IACS.

The process of the present invention and the advantages obtained thereby may be more readily understood from a consideration of the following illustrative examples.

EXAMPLE I

Electrolytic tough pitch copper (Alloy 110) was melted at 1200° C. under a charcoal cover. 0.01% by weight magnesium was then added to the alloy which was held at 1200° C. for 5 minutes and then cast. The resulting ingot was hot rolled at a starting temperature of 800° C., cold rolled, annealed at 600° C. and finally cold rolled to one-half hard temper. Resistance to softening was determined through measurements of Rockwell hardness (on the 15T scale) after exposure to temperatures between 200° and 700° C. The alloy was compared to Alloys 110, 114 (with 10 ounces of silver per ton) and 162 (with 25 ounces of silver per ton). The alloys were held at the various temperatures for 300 seconds at each temperature. The resistance to softening exhibited by each alloy is shown in FIG. 1. The results as shown in FIG. 1 can serve as a basis of comparison for the superimposed effects of niobium and zirconium as added in Example II. After 300 seconds of exposure to the various temperatures, it can be seen that the hardness of Alloy 110 to which the 0.01 weight percent magnesium has been added, is reduced to that of the silver-bearing copper alloys.

EXAMPLE II

Electrolytic tough pitch copper (Alloy 110) was melted under a lampblack cover. The melt was heated to 1200° C. and 0.01 weight percent magnesium was added. After holding the alloy at 1200° C. for 5 minutes, the temperature was subsequently elevated to 1300° C. and a 0.10 weight percent niobium addition was made to the alloy using a copper-niobium powder compact master. The melt was then held at 1300° C. for 20 minutes. The temperature of the melt was then reduced to 1200° C. and a 0.10 weight percent zirconium addition was then added to the niobium containing alloy using a copper-zirconium master alloy. The niobium and zirconium additions were also made, utilizing the same procedures, to an Alloy 110 melt which did not contain magnesium. The resultant ingots were than hot rolled, annealed and cold rolled to the one-half hard temper in the manner described previously in Example I. The resistance to softening of the niobium plus zirconium alloy compositions, with and without magnesium, relative to Alloys 110, 114, 155, 162 and a commercially available alloy containing 0.03 weight percent magnesium plus 0.03 weight percent zirconium, balance copper, was then measured. The alloys were held, as in Example I, at each temperature for 300 seconds. The electrical conductivities (% IACS) for each alloy were determined before each alloy was held at the various temperatures and the results are shown in Table I.

TABLE I

ELECTRICAL CONDUCTIVITIES FOR VARIOUS SOFTENING RESISTANT ALLOYS

| Alloy | Conductivity, % IACS |
|---|---|
| Cu-0.007 wt. % Nb-0.03 wt. % Zr* | 98.5 |
| Cu-0.005 wt. % Mg-0.02 wt. % Nb-0.02 wt. % Zr* | 98.5 |
| 110 | 101 |
| 114 | 101 |
| 155 | 90 |
| 162 | 90 |
| Cu-0.03 wt. % Mg-0.03 wt. % Zr | 93 |

*The composition of these alloys was chemically analyzed; the others were measurements of the alloy additions when added to the copper base.

It can be seen from Table I that the alloys of the present invention exhibit a higher electrical conductivity than alloys which are know to exhibit softening resistance (e.g., Alloys 155, 162).

Figure 2:
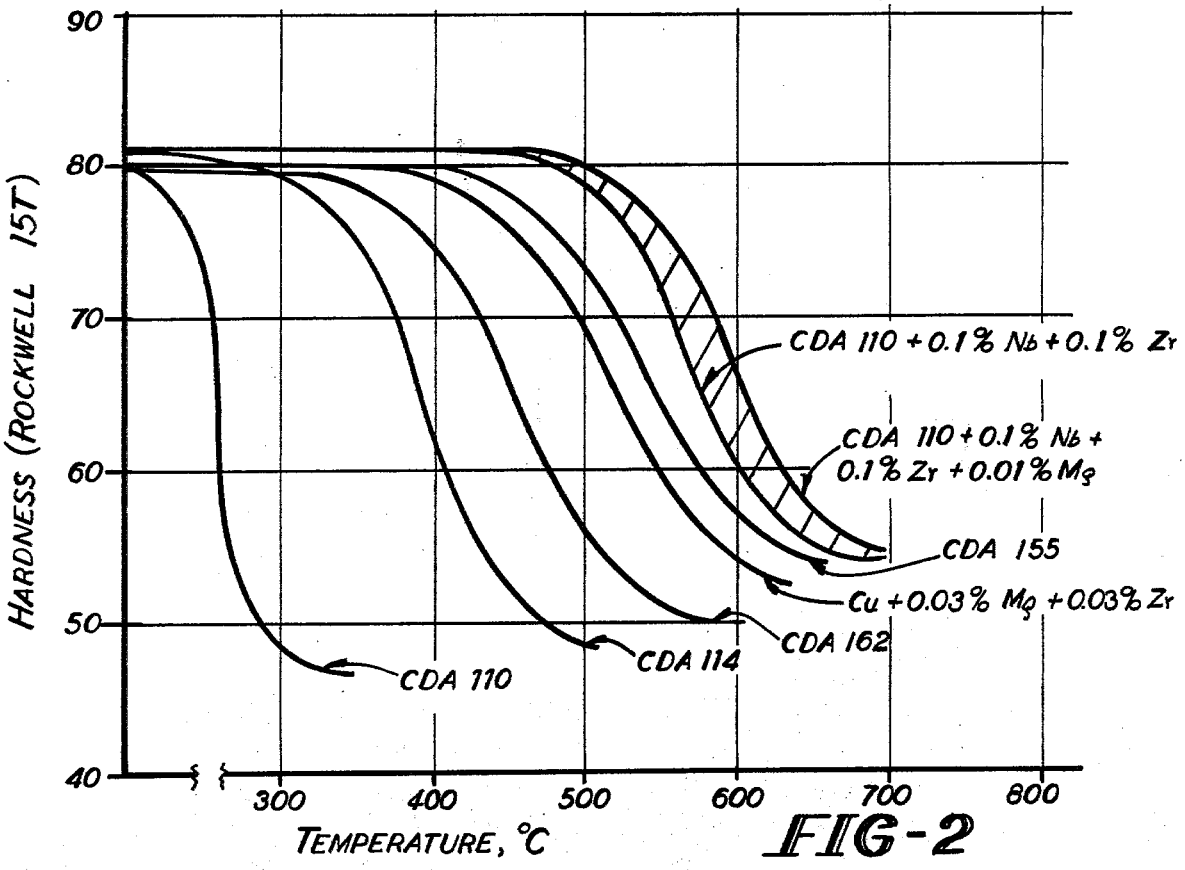
FIG. 2 is a graph showing the resistance to softening at various temperatures of several alloys, including the alloy system of the present invention.

The resistance to softening of the niobium plus zirconium alloys and Alloys 110, 114, 155, 162 and the commercial alloy are shown in FIG. 2. These alloys, as in Example I, were held 300 seconds at each temperature.

It can be seen that the combined addition of niobium and zirconium to the copper base alloy with or without magnesium produces a significant increase in softening resistance in the resulting alloy. The results shown in FIG. 2 clearly demonstrate the superior softening resistance of the alloy system of the present invention even to those alloys which are well known for their high softening resistance at elevated temperatures.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. An alloy capable of resisting softening at elevated temperatures while maintaining high strength and high electrical conductivity properties without depending upon the precipitation of alloying elements, said alloy consisting essentially of 0.005 to 0.2% by weight niobium, 0.005 to 0.2% by weight zirconium, said niobium and zirconium being essentially in solid solution in said alloy, balance copper.

2. An alloy as in claim 1 wherein 0.005 to 0.01% by weight magnesium is added to said alloy.

3. An alloy as in claim 1 wherein said alloy consists essentially of 0.01 to 0.05% by weight niobium, 0.01 to 0.05% by weight zirconium, balance copper.

4. An alloy as in claim 3 wherein up to 0.01% by weight magnesium is added to said alloy and wherein said alloy maintains an electrical conductivity of at least 90% IACS.

5. An alloy as in claim 1 wherein an element selected from the group consisting of zinc, nickel, tin, aluminum, silicon and combinations thereof is added to said alloy in an amount up to the limit of the respective element solubilities in the respective copper-element binary systems.

6. A process which does not depend upon the precipitation of alloying elements for improving both the high temperature softening resistance and strength properties of copper base alloys as well as maintaining a high electrical conductivity for said alloys, which comprises:

(a) casting a copper base alloy consisting essentially of 0.005 to 0.2% by weight niobium, 0.005 to 0.2% by weight zirconium, balance copper;
(b) hot working the alloy to effect the maximum solid solution of all alloying elements;
(c) cooling the alloy to maintain said maximum solid solution of all alloying elements;
(d) annealing said alloy at a temperature which will result in a desired yield strength and electrical conductivity while maintaining said niobium and zirconium essentially in solid solution in said alloy; and
(e) cold working said alloy to the final desired temper.

7. A process as in claim 6 wherein 0.005 to 0.01% by weight magnesium is added to said alloy and wherein said alloy maintains an electrical conductivity of at least 90% IACS.

* * * * *